US007984721B2

(12) United States Patent
Van Alphen

(10) Patent No.: US 7,984,721 B2
(45) Date of Patent: Jul. 26, 2011

(54) APPLICATOR FOR APPLYING A LIP PRODUCT TO THE LIPS

(75) Inventor: Bertus Johannes Van Alphen, Heiloo (NL)

(73) Assignee: BB3 B.V., Bergen (NL)

( * ) Notice: Subject to any disclaimer, the term of this patent is extended or adjusted under 35 U.S.C. 154(b) by 626 days.

(21) Appl. No.: 11/922,927

(22) PCT Filed: Jul. 10, 2006

(86) PCT No.: PCT/EP2006/006801

§ 371 (c)(1),
(2), (4) Date: Jun. 27, 2008

(87) PCT Pub. No.: WO2007/006559

PCT Pub. Date: Jan. 18, 2007

(65) Prior Publication Data

US 2009/0241982 A1 Oct. 1, 2009

(30) Foreign Application Priority Data

Jul. 13, 2005 (EP) ..... 05076608
Jan. 4, 2006 (EP) ..... 06075005

(51) Int. Cl.
*A45D 40/26* (2006.01)
*A45D 40/24* (2006.01)

(52) U.S. Cl. ..... 132/320; 132/317; 132/318

(58) Field of Classification Search ..... 132/320, 132/317, 318, 218; D28/85; 401/41, 130, 401/266, 267; 15/104.93, 104.94, 208, 209.1, 15/210.1

See application file for complete search history.

(56) References Cited

U.S. PATENT DOCUMENTS

| | | | | |
|---|---|---|---|---|
| 2,606,565 | A | 8/1952 | Sage | |
| 2,901,100 | A * | 8/1959 | Mueller et al. | 401/11 |
| 3,177,879 | A * | 4/1965 | Smith | 132/320 |
| 3,308,837 | A * | 3/1967 | Selleck | 15/104.94 |
| 3,568,236 | A * | 3/1971 | Aston | 15/244.1 |
| 3,863,654 | A * | 2/1975 | Morane et al. | 132/320 |
| 4,471,874 | A * | 9/1984 | Morane | 206/581 |
| 4,611,611 | A * | 9/1986 | Beal, Jr. | 132/320 |
| 4,838,851 | A * | 6/1989 | Shabo | 604/1 |
| 5,020,553 | A | 6/1991 | De La Rocha | |
| 5,285,799 | A * | 2/1994 | Minard | 132/200 |
| 5,881,743 | A * | 3/1999 | Nadel | 132/320 |
| 5,913,318 | A * | 6/1999 | Gueret | 132/293 |
| 6,227,737 | B1 * | 5/2001 | Lightfoot | 401/129 |
| 6,684,888 | B1 * | 2/2004 | Seabury | 132/320 |
| 2001/0017141 | A1 * | 8/2001 | Gueret | 132/320 |

(Continued)

*Primary Examiner* — Todd E Manahan
*Assistant Examiner* — Vanitha Elgart
(74) *Attorney, Agent, or Firm* — Birch, Stewart, Kolasch & Birch, LLP

(57) ABSTRACT

Applicator for applying a lip product (5) to the lips, includes a sheet-like flexible support (1) with a mouth end portion (2) and an opposite holding end portion (3) and on at least one side thereof a lip product area (4) carrying an amount of the lip product (5) such that at least a substantial part of a lip of a user can be brought into contact with the lip product (5) by taking the support (1) between the lips at the mouth end portion (2), the support (1) being grasped manually at the holding end portion (3) in use located outside the mouth of the user, the sheet-like flexible support (1) having an increasing flexibility from the mouth end portion (2) to the holding end portion (3) at least over a part of the lip product area (4).

20 Claims, 5 Drawing Sheets

U.S. PATENT DOCUMENTS

| | | | | |
|---|---|---|---|---|
| 2004/0089320 | A1* | 5/2004 | Williams et al. | 132/320 |
| 2007/0181143 | A1* | 8/2007 | Montoli | 132/320 |
| 2008/0083423 | A1* | 4/2008 | Dobler et al. | 132/320 |
| 2009/0211591 | A1* | 8/2009 | Hwang | 132/200 |
| 2009/0232580 | A1* | 9/2009 | Castel et al. | 401/41 |
| 2010/0200014 | A1* | 8/2010 | Lee | 132/320 |

* cited by examiner

APPLICATOR FOR APPLYING A LIP PRODUCT TO THE LIPS

BACKGROUND OF THE INVENTION

1. Field of the Invention

The present invention relates to an applicator for applying a lip product to the lips, at least comprising a sheet-like flexible support with a mouth end portion and an opposite positioned holding end portion, said sheet-like flexible support comprising on at least one side thereof a lip product area carrying an amount of said lip product, said lip product area being located on said support near the mouth end portion thereof in such a manner that at least a substantial part of at least one lip of a user can be brought into contact with said lip product in said lip product area by taking the support between the lips at the mouth end portion, said support being dimensioned such that it can be grasped manually at the holding end portion thereof which during use is located outside the mouth of the user.

2. Background of the Invention

Such an applicator is disclosed in U.S. Pat. No. 5,020,553. The applicator described in this United States specification is composed of a sheet of paper being provided on opposite main faces with an area of lipstick. The applicator is used by grasping the card between the lips of a user and then pulling it outwardly. This means that the lipstick is applied to the lips by a smearing action.

In practice this way of applying a lip product to the lips has proven to be not sufficiently accurate. Usually lumps of the lip product will be transferred which will have to be uniformly distributed afterwards. Also the corners of the mouth are apt to fouling.

In the cosmetics field already since the early 1930's attempts have been made to develop lip product applicators which comprise sheet-like material and are intended for single use. None of these products however was successful.

The main reason therefore was that in the cosmetics field lip products and especially lipstick have to be applied to the lips extremely accurately, which up till now has been impossible with the available sheet-like lipstick applicators according to the prior art. The only way at present to apply lipstick or other lip products to the lips sufficiently accurate is by using an ordinary lipstick or brush-like lipstick applicator.

The advantages of sheet-like lip product applicators are numerous. Sheet-like applicators can be used for promotional purposes as because of their flat shape they can be included in magazines and the like. Further they can be distributed at cosmetic stores, beauty salons and the like for sampling purposes as they are relatively cheap to manufacture. Persons using lip products, like women, make-up artists and the like, usually prefer to have more than one colour available as an easy-to-carry product. Ordinary lipsticks and lipstick brushes need to be carried in e.g. cosmetic boxes or purses. An important advantage of sheet-like applicators is that they can be easily carried in e.g. trouser pockets. Finally such lip product applicators are very hygienic. This is especially advantageous for for instance make-up artists and stylists who at present will use one lipstick or lip product applicator for several customers. The same also goes for sampling lipsticks in a store where usually many customers will try the same sampler.

SUMMARY OF THE INVENTION

In the art of cosmetics therefore there still exists an important demand for a sheet-like applicator which can apply lip products like lipstick accurately and reproducibly to the lips of a human being.

The present invention now provides such an applicator. According to the invention an applicator is provided for applying a lip product to the lips, at least comprising a sheet-like flexible support with a mouth end portion and an opposite positioned holding end portion, said sheet-like flexible support comprising on at least one side thereof a lip product area carrying an amount of said lip product, said lip product area being located on said support near the mouth end portion thereof in such a manner that at least a substantial part of at least one lip of a user can be brought into contact with said lip product in said lip product area by taking the support between the lips at the mouth end portion, said support being dimensioned such that it can be grasped manually at the holding end portion thereof which during use is located outside the mouth of the user, said applicator being characterized in that said sheet-like flexible support is designed in such a manner that it has an increasing flexibility from the mouth end portion to the holding end portion at least over a part of the lip product area of the support carrying the lip product.

Studies showed that by providing the sheet-like flexible support with an increasing flexibility an applicator can be obtained which now can successfully apply various lip products to the lips accurately without smearing.

In use the applicator according to the invention will be grasped between the lips at the mouth end portion, the holding end portion being grasped for example with two fingers. Then the holding end portion is moved up and down at least once without moving the sheet-like support relative to the lip surface. Because of the specific flexibility according to the invention of the sheet-like support the applicator will bend with a very advantageous curvature. In the bent condition the applicator at least over a part of the lip product area carrying the lip product will have a decreasing curvature radius.

The advantage of the applicator according to the invention is further that the so called cupids of the upper lip can also be provided with lip product very accurately.

Further it is important to note that with the applicator according to the invention lip product is applied by simple pressure transfer instead of a smearing action, the latter being obviously very inaccurate.

Preferably the sheet-like flexible support has an increasing flexibility over the part of the lip product area which is intended to contact the outer portions of the lips including the cupids when using the applicator.

During the application of a lip product with a sheet-like applicator according to the prior art major problems were encountered at the outer portions of the lips, i.e. the lip edges. Smearing and other inaccuracy effects were common. With the special design of the applicator according to the invention these disadvantages are overcome.

More preferably the sheet-like flexible support has an increasing flexibility over the entire lip product area.

This provides even better lip product application properties to the applicator, with higher accuracy.

Advantageously the sheet-like flexible support has an increasing flexibility over substantially its entire length from the mouth end portion to the holding end portion. This means that in use the flexibility will increase from the mouth end portion to the holding end portion which provides an optimum application of lip product. This means that when bending the applicator in use the curvature radius will decrease over the entire sheet-like support from the mouth end portion to the holding end portion, providing an excellent lip product transfer.

How the applicator is provided with the increasing flexibility is not limited and can be realized in many ways.

Preferably the increasing flexibility is obtained by providing the sheet-like flexible support with a specific shape, for example a decreasing width, such as a triangular shape or the like.

It is also preferred when the increasing flexibility is obtained by providing the sheet-like flexible support with a decreasing thickness. In this case the thickness will decrease from the mouth end portion to the holding end portion.

The flexibility can also be changed constructionally by providing the sheet-like support with for instance specifically designed ridges, grooves, holes etc.

Other possibilities for obtaining the increasing flexibility can be by altering the material properties of the sheet like support from the mouth end portion to the holding end portion at least over a part of the lip product area, e.g. by specifically changing the content of a filler or the like, or by providing suitable reinforcement materials to the material of the sheet-like support such as fibres, threads or the like.

Although not specifically stated it will be clear that preferably the flexibility of the sheet-like support increases gradually and more preferably with a substantially constant rate.

The increasing flexibility extends over substantially the entire width of the sheet-like support, but is not necessarily equal over the entire width. The flexibility will increase from the mouth end portion to the holding end portion of the sheet-like support at least over a part of the lip product area but the increase in flexibility may vary over the width of the sheet like support. For example the increase in flexibility may be higher near the edges of the sheet-like support in its transverse (width) direction. That is, in use the sheet-like support may have the same curvature radius in the corners of the mouth as at the position of the cupids.

In a preferred embodiment the sheet-like flexible support has a substantially triangular shape with rounded corners and has a substantially constant thickness, and the lip product area being designed in a curved band near a base of the triangular shape in order to approach the curvature of the lips of a user when used. This embodiment will be further illustrated in the drawings.

In a further preferred embodiment the sheet-like flexible support is substantially rectangular with rounded corners and has a relatively constant decreasing thickness from the mouth end portion to the holding end portion, and the lip product area being designed in a curved band near the mouth end portion in order to approach the curvature of the lips of a user when used. This embodiment will also in more detail be described with reference to the drawings.

Of course the sheet-like flexible support can carry a lip product in the lip product area on only one side near the mouth end portion, but preferably the sheet-like flexible support comprises two lip product areas carrying lip product on both sides near the mouth end portion. This provides the possibility of applying the lip product to both lips simultaneously.

The lip product which is applied to the sheet-like flexible support can be any lip product which has to be applied to the lip of a user. Examples thereof are products used in the field of lip cosmetics, such as lipstick, lip liniment, lip gloss etc.; in the field of lip care, such as lip emollient, lip balsam etc.; in the field of lip protection, such as lip sun protection agent etc.; and in the field of lip pharmaceuticals, such as anti herpes labialis agent, etc. The physical state of the lip product is also not specifically limited and can be solid, semi solid, powder or liquid etc.

Although the applicator according to the invention will predominantly be designed for single use only it can be advantageous to design said applicator for multiple use. In this case preferably the lip product is for example applied to the sheet-like flexible support in a layered manner such that the applicator can be used more than once. By layered in this case is meant that more than one layer of lip product is applied to the sheet-like support separated by e.g. separation layers, being layers e.g. having a higher viscosity or higher melting point. By using such an applicator only one layer of lip product will be transferred from the applicator to the lips of a user per application.

The sheet-like support of the applicator according to the invention is preferably made of a flexible plastic. Plastics generally used in the cosmetics field are advantageous, for example polypropylene, polyethylene, polystyrene etc.

Further it is noted that the dimensions of the applicator according to the invention are not critical. Of course the dimensions should be selected appropriately such that the mouth end portion can be grasped between the lips with the lip product accessible for the lips. Also the thickness can be selected depending on the intended use and the material of the sheet-like support. An example of a typical applicator made of polystyrene has the following estimated dimensions: a length of about 5-6 cm between the mouth end portion and the holding end portion, a maximum width near the mouth end portion of about 5 cm and a thickness of about 0.5 mm.

The invention further provides a method for manufacturing an applicator according to the invention comprising the steps of:

providing a sheet-like flexible support comprising a lip product area, coating said sheet-like flexible support with a lip product in said lip product area, wherein the sheet-like flexible support is coated with lip product by moving a lip product coating device and the sheet-like flexible support relative to each other. One of the lip product coating device or the sheet-like flexible support can be moved or both.

Preferably the lip product coating device and/or the sheet-like flexible support are moved relative to each other along an arcuate path, in such a manner that the correct curved shape of the lip product in the lip product area of the sheet-like flexible support is obtained.

Advantageously the sheet-like flexible support is grasped at the holding end portion by suitable means during coating of the lip product.

Finally the invention provides an apparatus for manufacturing applicators according to the invention, at least comprising:

transport means for transporting sheet-like flexible supports and a lip product coating device for coating lip product in the lip product area of the sheet-like flexible supports by moving the sheet-like flexible supports and the lip product coating device relative to each other, wherein the lip product coating device comprises a coating arm comprising at one end a slit with lip product feed means, said slit being aligned with the main face of the sheet-like flexible supports, and can interact with the sheet like flexible supports by moving the sheet-like flexible supports through said slit in order to suitably coat the sheet-like flexible supports with lip product.

Preferably the arm is rotatable in the longitudinal direction of the slit and comprises drive means for rotating the arm. In this manner an arcuate shape of the lip product can be coated on the sheet like flexible supports. The arm can either reciprocate or make full 360 degree turns Of course the lip product coating device can also be fixed and the transport means of the sheet like flexible supports being designed such that the sheet like flexible supports can be moved along an arcuate path, or both can be moved suitably relative to each other.

Advantageously the coating device further comprises an open lip product container above which the coating arm is positioned, the lip product feed means of the coating arm being connected to the container by the interposition of suitable pump means. In this way lip product can be pumped continuously from the container to the slit in the coating arm. Superfluous lip product can flow back into the container. In practice usually heating means will also be present to keep the lip product in a liquid state.

BRIEF DESCRIPTION OF THE DRAWINGS

In the following the invention will be illustrated by reference to the drawings, wherein.

DETAILED DESCRIPTION OF THE PREFERRED EMBODIMENTS

In the following discussion as a lip product only lipstick is cited, which by no means should be interpreted as limiting the invention as the applicator according to the invention can be used for any lip product such as known for instance in the field of cosmetics, pharmaceuticals etc, which is susceptible of being applied with the applicator according to the invention.

Figure 1:
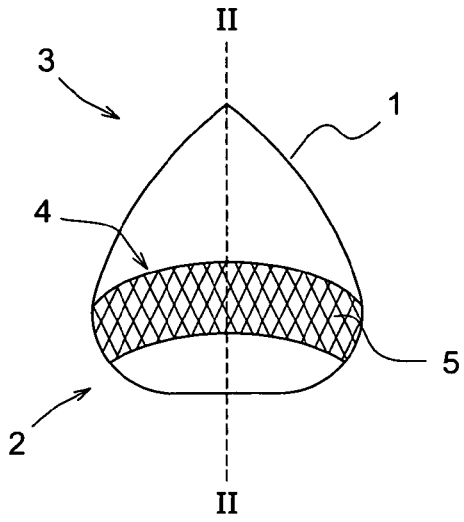
FIG. 1 shows a first embodiment of an applicator according to the invention with a substantially triangular shape.

In FIG. 1 an applicator according to the invention is shown, comprising a sheet-like support 1 with a mouth end portion 2 and a holding end portion 3. Near the mouth end portion 2 a lip product area 4 is present designed as a curved band carrying an amount of lipstick 5. Said curvature is not critical, although it is preferred that it substantially follows the curvature of the lips of a user. The shape of the lip product area 4 is not critical. Also larger lip product areas and/or different shapes can be used as will be shown in other figures.

Because of the substantially triangular shape of the applicator according to the invention the flexibility will increase from the mouth end portion 2 to the holding end portion 3 at least over a substantial part of the lip product area 4 and in this case over almost the entire applicator. When the applicator according to the invention is grasped between the lips of a user at the position of the band shaped area 4 with lipstick 5 and the holding end portion 3 is grasped by two fingers and moved up and down (bent), during all stages of bending the radius of curvature of the applicator will decrease from the mouth end portion to the holding end portion.

According to the invention studies showed that it is essential that the flexibility increases at least over a part of the lip product area from the mouth end portion to the holding end portion. This will be a part of the lip product area contacting the lips during lipstick transfer. Preferably this is the part of the lip product area which during use will contact the edges of the lips, where the specific curvature obtained by the invention is critical for an accurate application of lipstick.

Figure 2:
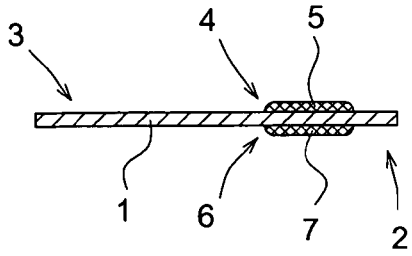
FIG. 2 shows a cross-section of the applicator according to FIG. 1 along line II-II.

In FIG. 2 a cross-section of the applicator according to FIG. 1 along line II-II is shown. In this cross-section it is clear that apart from the lip product area 4 with lipstick also a second lip product area 6 comprising lipstick 7 is present on the opposite side of the applicator. In this way both lips can be provided with lipstick simultaneously.

Figure 3:
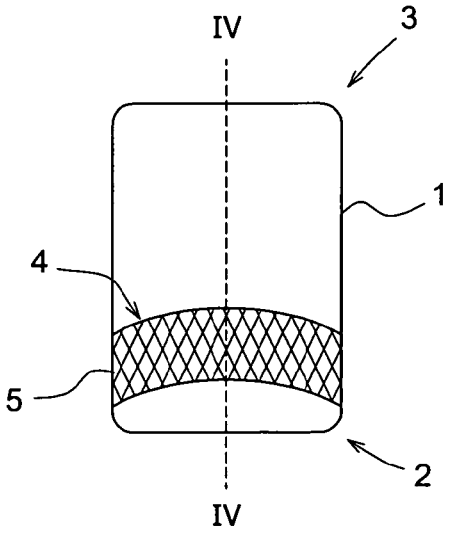
FIG. 3 shows another embodiment of the applicator according to the invention with a substantially rectangular shape.

In FIG. 3 a second embodiment of the applicator according to the invention is shown in a substantially rectangular shape. Here also the mouth end portion 2 and the holding end portion 3 are shown including the lip product area 4 in the shape of a curved band with lipstick 5 positioned near the mouth end portion 2.

Figure 4:
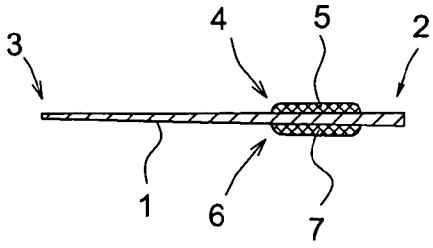
FIG. 4 shows a cross-section of the applicator according to FIG. 3 along line IV-IV.

With this embodiment the increasing flexibility of the sheet-like support is obtained by providing the sheet-like support 1 with a decreasing thickness starting from the mouth end portion 2 towards the holding end portion 3. This is more clearly shown in FIG. 4, which shows a cross-section of FIG. 3 along line IV-IV.

Also in this case the applicator is provided with a second lip product area 6 with lipstick 7 located on the surface opposite to the surface carrying the lip product area 4 with lipstick 5.

The lip product areas can be provided with different colours or different kinds of lipstick or even each area can be provided with different colours or different kinds. Also multi-component products, which can be the case with certain pharmaceutical lip products, can be applied with the applicator according to the invention by providing one component on one side of the applicator and another on the other side. In this way the components will only come into contact with each other after transfer to the lips of a user.

Figure 5A:
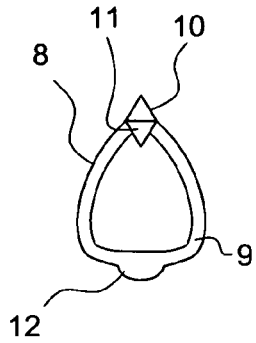
FIGS. 5(*a*) and 5(*b*) show a package containing the applicator according to FIG. 1.
Figure 5B:
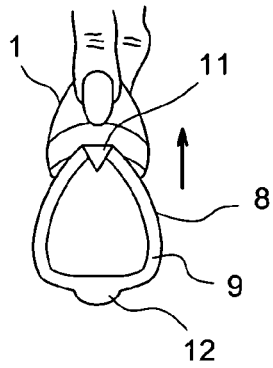

FIG. 5 shows a package 8 for packaging an applicator according to FIG. 1 with a substantially triangular shape. Said package 8 comprises two film-like members being sealed in a releasable manner at a peripheral edge 9. The film-like members will on the side contacting the applicator be provided with a specific release coating to prevent lipstick from adhering thereto.

The film members are not sealed at the position of the lips 10 and 11. By grasping the lips 10 and 11 the film members can be separated and the package 8 opened. After opening the applicator can be removed from the package 8. Obviously the seals can be designed in such a way that after use the applicator can be put back into the package and the seals closed again by pressure. Specific resealable sealing materials are well known in the field.

Opposite of the lips 10 and 11 for opening the package preferably a holding lip 12 is present forming a part of the sealed peripheral edge 9. This lip 12 serves the purpose of providing the user with the possibility of firmly gripping the package 8 when opening it and while removing the applicator according to the invention without squeezing the applicator itself in the package, which would of course hamper removal thereof and might even lead to smearing of the lipstick over the sheet-like support 1.

Figure 6A:
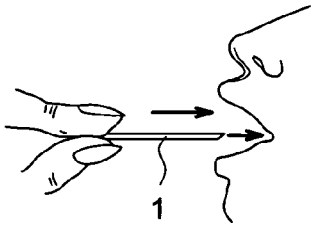
FIG. 6(*a*)-(*c*) show the method of using the applicator according to the invention for transferring lipstick to the lips of a user.
Figure 6B:
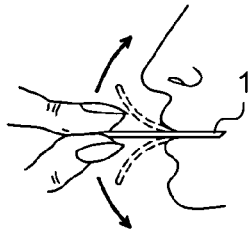
Figure 6C:
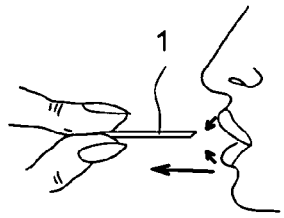

FIG. 6(*a*)-(*c*) show the different steps of using the applicator according to the invention for applying lipstick to the lips of a user.

In FIG. 6(*a*) the applicator is positioned in the mouth of a user by grasping the applicator at the holding end portion 3 with two fingers.

Thereafter the mouth is closed whereby the lips are brought into contact with the lip product 5,7 in the lip product areas 4,6, as shown in FIG. 6(*b*). Then the applicator is bent up and down at least once. The mouth is opened again and the applicator is removed as shown in FIG. 6(*c*), then the lips can if deemed necessary be pressed together to more evenly distribute the lipstick. This will however sometimes only be necessary to more evenly distribute the lipstick but not to better position the lipstick as the use of the applicator according to the invention already provides an accurate transfer of lipstick to the lips without smearing over the edges of the lips or transferring lumps of lipstick.

In a specific embodiment the applicator according to the invention is provided with signalling means which indicate to the user that the lip product is applied correctly. These means can for instance comprise a specific construction measure which will provide an audible signal when the applicator according to the invention is bent sufficiently. This construction measure can for instance comprise a suitable combination of grooves and/or ridges which will provide a snap with a sound when a certain force threshold is passed i.e. when the applicator is bent sufficiently and lip product has been provided correctly.

Figure 7:
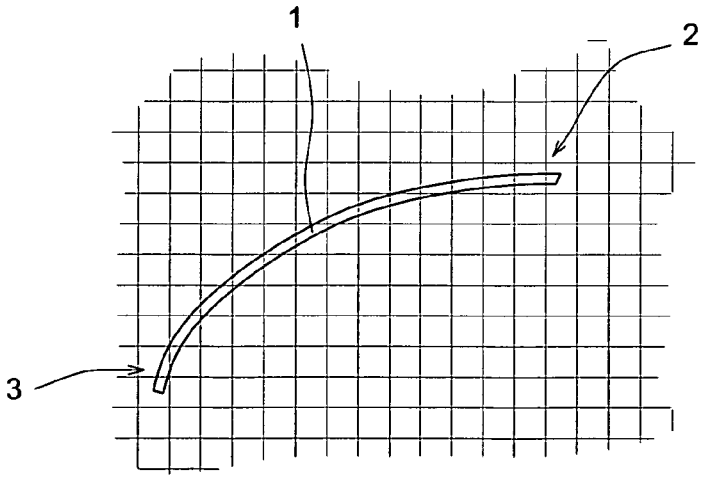
FIG. 7 is a schematic representation of an example of the increasing flexibility of the applicator according to the invention by showing the decreasing radius of curvature.

FIG. 7 shows an example of a bent applicator according to the invention having an increasing flexibility from the mouth end portion to the holding end portion. Here it can be clearly seen that when bent the radius of curvature of the applicator decreases from the mouth end portion to the holding end portion, which is an essential characteristic of the applicator according to the invention.

Figure 8:
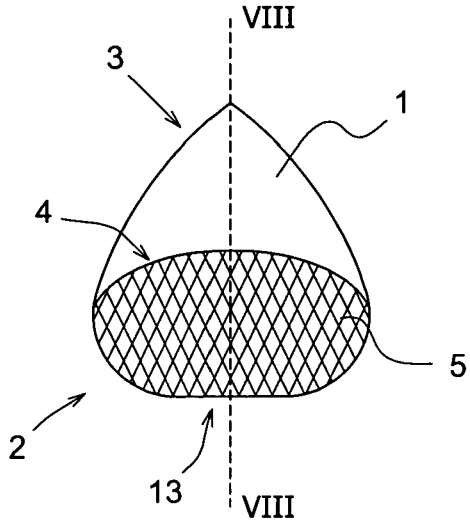
FIG. 8 shows a further embodiment of the applicator according to the invention similar to the applicator shown in FIG. 1.

FIG. 8 shows an additional embodiment of the applicator according to the invention more or less similar to the embodiment shown in FIG. 1. The applicator comprises the same sheet-like flexible support 1 with two lip product areas 4,6 on both sides thereof. The main difference is that the lip product areas 4,6 now extend to the leading edge 13 of the mouth end portion 2. This embodiment is easier to manufacture due to lower accuracy requirements for applying the lip product. Also if in use or in the package some smearing would occur near the mouth end portion this will not be visible with this embodiment because of the design of the lip product area 4,6.

Figure 9:
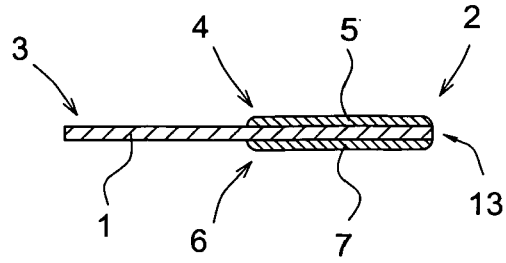
FIG. 9 shows a cross-section of the applicator according to FIG. 8 along line VIII-VIII.

FIG. 9 shows a cross-section of the applicator according to FIG. 8 along line VIII-VIII.

Figure 10:
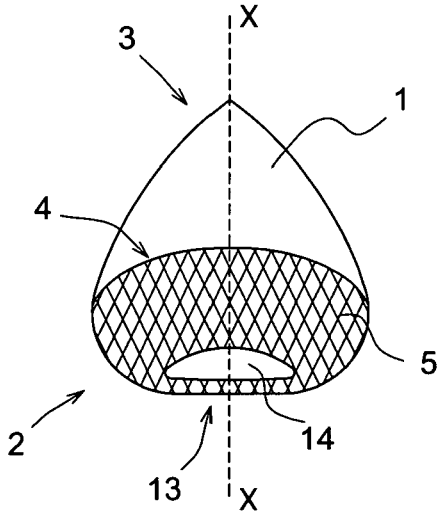
FIG. 10 shows another embodiment of the applicator according to the invention having an aperture near the mouth end portion.

FIG. 10 shows an embodiment of the applicator according to the invention comprising an aperture 14 in the lip product area 4 near the leading edge 13 of the mouth end portion 2. This aperture 14 also prevents fouling of the applicator during use.

Figure 11:
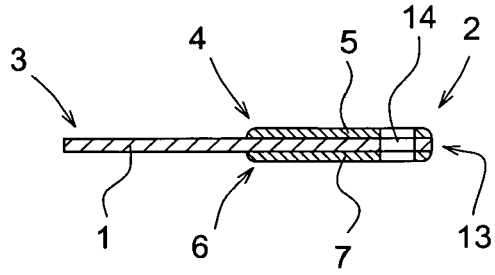
FIG. 11 shows a cross-section of the applicator according to FIG. 10 along line X-X.

FIG. 11 shows a cross-section of the applicator according to FIG. 10 along line X-X.

FIG. 8-11 are also shown to make clear that many different shapes and designs of the applicator according to the invention can be used in practice.

Figure 12:
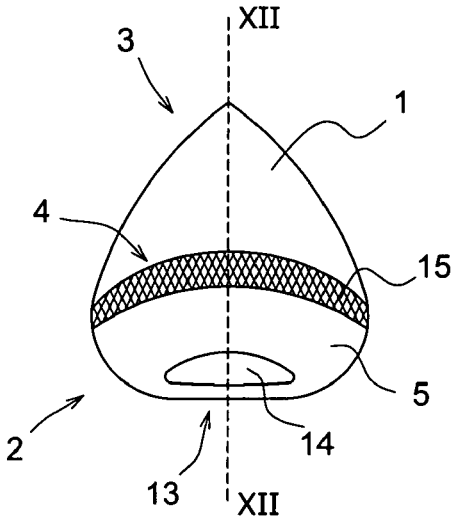
FIG. 12 shows an embodiment of the applicator similar in shape to the applicator according to FIG. 10 having an aperture.

FIG. 12 shows an embodiment of the applicator according to the invention having two bands 5 and 15 of lipstick in the lip product area 4. The two bands 5 and 15 of lipstick have different properties. Preferably the band 15 has a consistency similar to regular lipstick whereas the band 15 has a consistency lower than that of regular lipstick. The advantage of this embodiment is that in use the band 5 will be transferred relatively easy to the lips while the band 15 provides a smear protection band, which prevents smearing of lipstick from the lip product area 4 to the holding end portion 3 of the applicator. When the applicator is used more than once than the band 15 of lipstick will also be transferred to the lips.

Figure 13:
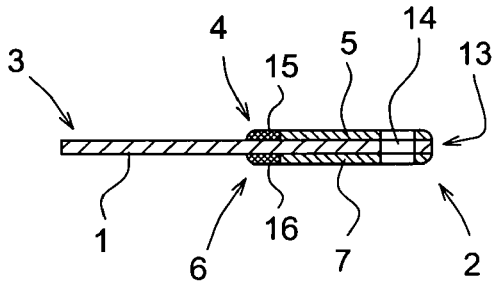
FIG. 13 shows a cross-section of the applicator according to FIG. 12 along line XII-XII.

FIG. 13 shows a cross-section of the applicator according to FIG. 12 along line XII-XII. In this figure the other side of the applicator is also visible, carrying a lip product area 6 also with two bands 7 and 16 of lipstick with similar properties as the respective bands 5 and 15 on the other side.

Numerous modifications of the applicator according to the invention are possible in view of the above description. An example thereof is the following. Advantageously the sheet-like support can, instead of carrying an amount of lip product adhered to the lip product area, be provided in the lip product area with e.g. absorbent material, or material having such specific characteristics that a lip product adheres better thereto than to the remainder of the support. Further a package is in that case provided which contains a certain amount of lip product which will be transferred to this specially designed material in the lip product area in order to be applied to the lips of a user as described earlier. In this way the disposable character of the applicator is altered and it is made suitable for more than one application.

Figure 14:
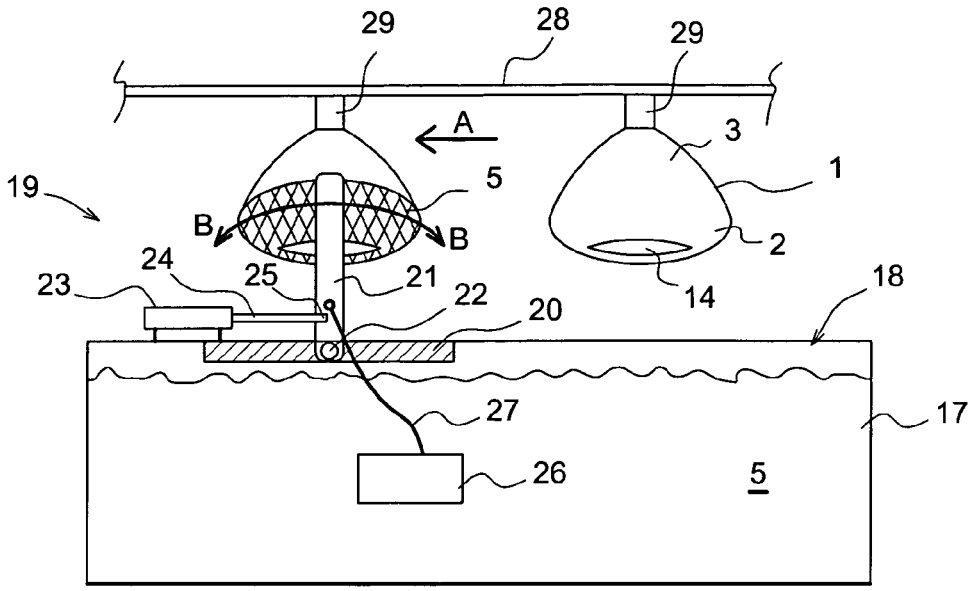
FIG. 14 shows a schematic representation of an apparatus for manufacturing an applicator according to the invention using a coating arm.

FIG. 14 shows a schematic representation of an embodiment on an apparatus for providing sheet-like flexible supports according to the invention with lip product in order to manufacture applicators according to the invention. Said device comprises a lip product container 17 comprising a lip product, in this case a lipstick 5 in a molten condition of which the liquid surface is schematically shown. Therefore suitable heating means are present, which are not shown. The container 17 is open at the upper side 18.

Above the container 17 a lip product coating device 19 is supported said apparatus 19 comprising a support 20 carrying a rotatable coating arm 21 which can rotate about axis 22. The arm can be rotated in a reciprocating manner by a piston device 23 comprising a piston arm 24 which is rotatably connected to the rotating arm 21 at 25.

The coating arm 21 is further connected with feed means comprising a pump 26 and a feed conduit 27. By this pump 26 liquid lip product 5 can be pumped into the coating arm 21 to be applied on a sheet-like flexible support. The configuration of the part of the coating arm 21 applying lipstick will be described with reference to the next figure. The coating arm 21 thereto comprises a slit in the upper part thereof.

Further transporting means are shown in the form of a conveyor 28 comprising clamps 29 for clamping flexible sheet-like supports 1 according to the invention at the holding end portion 3 thereof. The arrow A above the conveyor means shows the direction of movement of the conveyor 28.

By moving a sheet-like flexible support 1 in an interactive position with the coating arm 21 said flexible support 1 can be coated with lip product 5.

Figure 15:
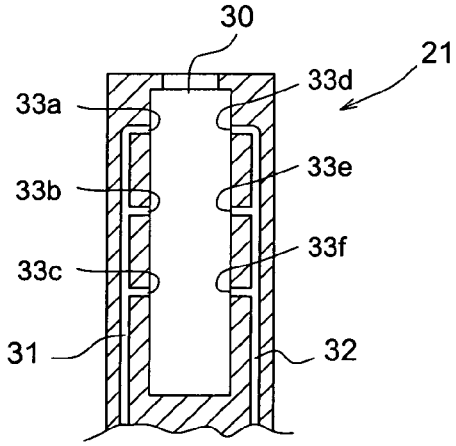
FIG. 15 shows a cross-section of the coating arm of the device according to FIG. 14 showing the slit.

FIG. 15 shows a schematic example of a partial cross-section of upper part of the coating arm 21 comprising a slit 30. Internal feed channels 31 and 32 which open in one or more discharge openings 33 (e.g., discharge openings 33*a-f* as shown in FIG. 15) inside the slit 30 are connected to the feed conduit 27. In this case inside the slit 30 at the position of the discharge openings 33 said slit 30 has somewhat larger transvers dimensions in order to be able to accurately control the thickness of the lip product layer applied to the sheet-like flexible support 1.

In operation a sheet-like flexible support 1 is brought into the slit 30 of the coating arm 21 as shown in FIG. 14 and thereafter the coating arm 21 is rotated in the direction of the arrows B while lip product is fed through the feed conduit 27 to the discharge openings 33 from the container 17. By the specific configuration of the apparatus it is possible to feed the liquid lip product 5 continuously without having to accurately control the feed rate thereof, because excess lip product 5 can flow back into the container without doing any harm. Especially lipstick in a liquid condition (heated) has a very low viscosity. In this manner a semi continuous coating process can be performed with the device.

The number and arrangement of the discharge openings 33 is not limited and can be altered as necessary.

It will be clear that many modifications can be made to the device without departing from the scope of the invention. For example the arm can be stationary and the conveyor path can be modified in such a way that still the arcuate shape of the lip product on the sheet-like flexible support 1 can be manufactured.

The invention claimed is:

1. An applicator for applying a lip product to the lips, at least comprising a sheet-like flexible support with a mouth end portion and an opposite positioned holding end portion, said sheet-like flexible support comprising on at least one side thereof a lip product area carrying an amount of said lip product, said lip product area being located on said support near the mouth end portion thereof in such a manner that at least a substantial part of at least one lip of a user can be brought into contact with said lip product in said lip product area by taking the support between the lips at the mouth end portion, said support being dimensioned such that said support can be grasped manually at the holding end portion thereof which during use is located outside the mouth of the user, wherein said sheet-like flexible support is designed in such a manner that said sheet-like flexible support has an increasing flexibility from the mouth end portion to the holding end portion at least over a part of the lip product area of the support carrying the lip product.

2. The Applicator according to claim 1, wherein the sheet-like flexible support has an increasing flexibility over the part of the lip product area which is intended to contact the outer portions of the lips including the cupids when using the applicator.

3. The Applicator according to claim 1, wherein the sheet-like flexible support has an increasing flexibility over the entire lip product area.

4. The Applicator according to claim 1, wherein said sheet-like flexible support has an increasing flexibility over substantially an entire length thereof from the mouth end portion to the holding end portion.

5. The Applicator according to claim 1, wherein the increasing flexibility is obtained by providing the sheet-like flexible support with a decreasing width.

6. The Applicator according to claim 1, wherein the increasing flexibility is obtained by providing the sheet-like flexible support with a decreasing thickness.

7. The Applicator according to claim 1, wherein said sheet-like flexible support has a substantially triangular shape with rounded corners and has a substantially constant thickness, and that the lip product area is designed in a curved band near a base of the triangular shape in order to approach the curvature of the lips of a user when used.

8. The Applicator according to claim 1, wherein said sheet-like flexible support is substantially rectangular with rounded corners and has a relatively constant decreasing thickness from the mouth end portion to the holding end portion, and that that the lip product area is designed in a curved band near the mouth end portion in order to approach the curvature of the lips of a user when used.

9. The Applicator according to claim 1, wherein said sheet-like flexible support carries a lip product area comprising a lip product on both sides near the mouth end portion.

10. The Applicator according to claim 1, wherein said lip product is applied to the sheet-like flexible support in a layered manner such that the applicator can be used more than once.

11. The Applicator according to claim 2, wherein sheet-like flexible support has an increasing flexibility over the entire lip product area.

12. The Applicator according to claim 2, wherein said sheet-like flexible support has an increasing flexibility over substantially an entire length thereof from the mouth end portion to the holding end portion.

13. The Applicator according to claim 3, wherein said sheet-like flexible support has an increasing flexibility over substantially an entire length thereof from the mouth end portion to the holding end portion.

14. The Applicator according to claim 2, wherein the increasing flexibility is obtained by providing the sheet-like flexible support with a decreasing width.

15. The Applicator according to claim 3, wherein the increasing flexibility is obtained by providing the sheet-like flexible support with a decreasing width.

16. The Applicator according to claim 4, wherein the increasing flexibility is obtained by providing the sheet-like flexible support with a decreasing width.

17. The Applicator according to claim 2, wherein the increasing flexibility is obtained by providing the sheet-like flexible support with a decreasing thickness.

18. The Applicator according to claim 3, wherein the increasing flexibility is obtained by providing the sheet-like flexible support with a decreasing thickness.

19. The Applicator according to claim 4, wherein the increasing flexibility is obtained by providing the sheet-like flexible support with a decreasing thickness.

20. The Applicator according to claim 2, wherein said sheet-like flexible support has a substantially triangular shape with rounded corners and has a substantially constant thickness, and that the lip product area is designed in a curved band near a base of the triangular shape in order to approach the curvature of the lips of a user when used.

* * * * *